US007399287B2

(12) United States Patent
Meisch

(10) Patent No.: US 7,399,287 B2
(45) Date of Patent: Jul. 15, 2008

(54) HAND HELD TEMPLE MASSAGER

(76) Inventor: Joseph G. Meisch, 12 Sunrise Mt. Rd., Cazadero, CA (US) 95421

( * ) Notice: Subject to any disclaimer, the term of this patent is extended or adjusted under 35 U.S.C. 154(b) by 268 days.

(21) Appl. No.: 10/851,410

(22) Filed: May 21, 2004

(65) Prior Publication Data

US 2004/0267174 A1 Dec. 30, 2004

Related U.S. Application Data

(60) Provisional application No. 60/473,114, filed on May 22, 2003.

(51) Int. Cl.
*A61H 7/00* (2006.01)

(52) U.S. Cl. ..... 601/137; 601/136

(58) Field of Classification Search ..... 601/133–142, 601/97, 107, 108, 111, 46, 72, 73, 78, 80, 601/84

See application file for complete search history.

(56) References Cited

U.S. PATENT DOCUMENTS

| | | | | | |
|---|---|---|---|---|---|
| 882,700 | A * | 3/1908 | Lewis | 181/131 |
| 1,151,583 | A * | 8/1915 | Hanson | 606/122 |
| 1,313,448 | A | 8/1919 | Anderson | |
| 1,612,899 | A * | 1/1927 | Ahlgren | 601/133 |
| 2,482,838 | A * | 9/1949 | Carlson | 601/136 |
| 2,690,746 | A * | 10/1954 | Achberger | 601/133 |
| 2,959,167 | A * | 11/1960 | Leclabart | 601/133 |
| 3,504,665 | A * | 4/1970 | Bakunin et al. | 601/71 |
| 3,585,884 | A * | 6/1971 | Leckie et al. | 81/13 |
| 3,716,048 | A * | 2/1973 | Alonso | 601/95 |
| 3,985,050 | A * | 10/1976 | Lurie | 81/118 |
| D262,574 | S | 1/1982 | Lindberg | |
| 4,320,760 | A * | 3/1982 | Sun et al. | 606/204 |
| 4,683,875 | A * | 8/1987 | Rabinowitz | 601/141 |
| 5,632,721 | A * | 5/1997 | Kuan | 601/135 |
| 5,728,050 | A * | 3/1998 | Lin | 601/107 |
| 5,792,081 | A * | 8/1998 | Cross | 601/123 |
| 6,174,298 | B1 * | 1/2001 | Quinn et al. | 601/137 |
| D438,978 | S | 3/2001 | Conwell | |
| 6,315,743 | B1 | 11/2001 | Guest | |
| 6,368,293 | B1 * | 4/2002 | Orgeron et al. | 601/15 |
| 6,450,980 | B1 * | 9/2002 | Robbins et al. | 601/137 |
| D477,406 | S * | 7/2003 | Schroer | D24/143 |
| 6,607,499 | B1 * | 8/2003 | Becher | 601/133 |
| 2002/0049400 | A1 * | 4/2002 | Lacey | 601/137 |
| 2003/0083600 | A1 | 5/2003 | Robbins | |
| 2003/0208144 | A1 * | 11/2003 | Sorlie et al. | 601/137 |
| 2004/0049138 | A1 * | 3/2004 | Li | 601/137 |

* cited by examiner

*Primary Examiner*—Patricia Bianco
*Assistant Examiner*—Huong Q. Pham
(74) *Attorney, Agent, or Firm*—Craig M. Stainbrook; Stainbrook & Stainbrook, LLP

(57) ABSTRACT

A hand held temple massager having a handle and two spaced-apart arms extending in substantially the same plane from an end of the handle. Each arm includes a distal portion and a proximal portion, the latter integrally connected to the handle. The distal portion of each arm includes means to capture and retain a pressure member with temple-engaging portion for applying pressure directly to the temple area of a user to treat and prevent a tension headache. The massager includes pressure adjustment means disposed between said first and second arms to tailor the pressure applied by the massager, and may also include a small vibrating motor powered by batteries.

9 Claims, 2 Drawing Sheets

HAND HELD TEMPLE MASSAGER

CROSS REFERENCE TO RELATED APPLICATIONS

The present application claims the benefit of the filing date of U.S. Provisional Patent Application, Ser. No. 60/473,114, filed May 22, 2003 (May 22, 2003).

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to massage apparatus, and more particularly to hand held self-massage apparatus, and more particularly still to a vibrating hand held temple massager with tension adjustment means.

BACKGROUND INFORMATION AND DISCUSSION OF RELATED ART

It is well known that tension headaches can be alleviated, at least in part, by massaging the scalp and/or the temples. However, self-massage is almost always inferior to massage by another, as the muscular effort required to elevate the arms and exert pressures on the temples can actually increase tension in the neck and shoulders, which is as often as not the very cause of a tension headache. Furthermore, it is also difficult to find a person sufficiently skilled, sympathetic, and available to massage one's temples when it would be helpful to reduce a headache. Accordingly, a number of devices have been conceived to provide a headache sufferer the means to apply headache-reducing pressure to his or her own temples. Among the exemplary devices are the following:

U.S. Pat. No. 6,315,743 to Guest, discloses a clamping apparatus for applying constant pressures to the temple areas of a user's head. It comprises a C-shaped frame which fits over the top of the user's head such that each end of the frame member is generally aligned with one of the user's temples. Each end of the frame includes a threaded head contact assembly which is screwed inwardly to engage a temple area. Pressure can be increased or decreased by adjusting the contact assemblies. The device also includes a height adjustment assembly coupled to the top of the C-shaped frame member which allows the user to adjust the height of the frame relative to the temple areas.

U.S. Pat. No. 6,450,980 to Robbins, et al., shows a massage device for the head or scalp having flexible, metallic prongs or fingers extending from a handle to form a space of substantially uniform circumference. The flexible, elongated members are bendable and have free ends which are used to contact and apply stimulating sensations to a body portion.

U.S. Design Pat. No. D477,406 to Schroer, teaches a head clamp having two arcuate arms pivotally connected at one end and having arcuate extensions pivotally connected at the other. The extensions have an inwardly disposed pad at their respective terminal ends. The device is collapsible and may be stored in a small pocket, but when deployed offers a head clamp that bears a resemblance to contemporary headphones.

U.S. Pat. No. 2,482,838 to Carlson, discloses a massaging device for self-massage that comprises a frame and two spring-loaded L-shaped members that are pressed against the forehead. The user moves the frame back and forth, toward and away from the forehead, and while doing so the L-shaped members exert a pressure against the forehead and temple areas.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention is a lightweight hand held temple massager that provides self-massage benefits of adjustable and agreeable pressure to the temple areas while simultaneously providing stimulating and pleasant vibration to enhance the headache-reducing effects of use.

It is an object of the present invention to provide a new and improved hand held temple massager that allows the user to conduct a self-massage of the temple area to reduce tension headache.

It is another object of the present invention to provide a new and improved hand held temple massager that is lightweight and portable.

A further object or feature of the present invention is to provide a new and improved hand held temple massager that includes means for adjusting pressure applied to the temple areas.

An even further object of the present invention is to provide a novel hand held temple massager that includes vibration means to add a vibration component to the pressure component of the self-massage.

A still further object of the present invention is to provide a new and improved hand held temple massager that includes a variety of temple pads or tips with various degrees of resilience and various tip configurations that can be replaced, cleaned, and/or substituted according to the desired sensation sought in the massage.

Yet another object of the present invention is to provide a new and improved hand held temple massager that is simple and inexpensive to manufacture.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

Figure 1:
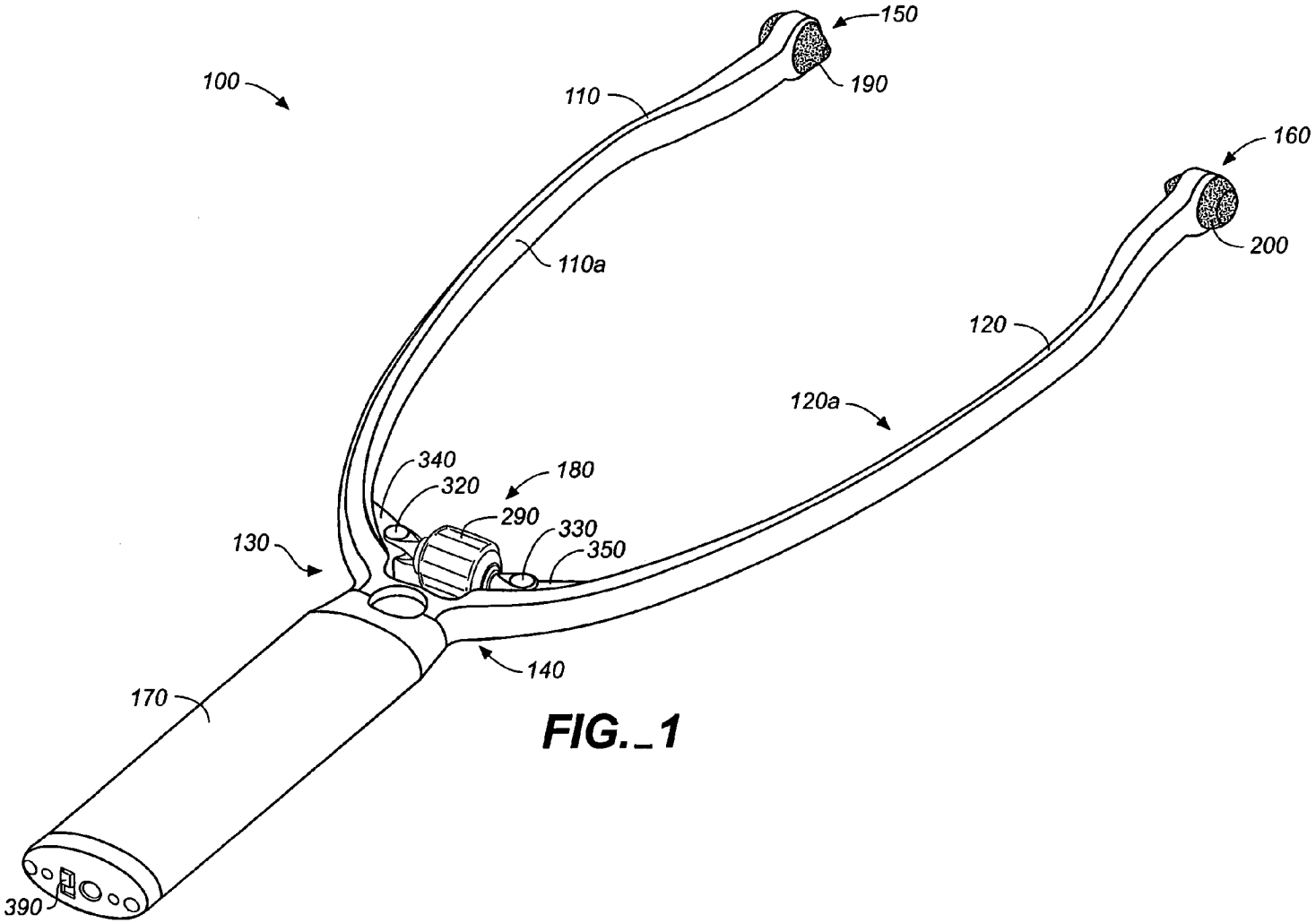
FIG. 1 is a perspective view of the hand held temple massager of the present invention.

| Drawing Reference Numerals | |
|---|---|
| 100 | inventive hand held temple massager, generally |
| 110 | first arcuate arm |
| 110a | interior surface (of first arcuate arm) |
| 120 | second arcuate arm |
| 120a | interior surface (of second arcuate arm) |
| 130 | proximal end (of first arcuate arm) |
| 140 | proximal end (of second arcuate arm) |
| 150 | distal end (of first arcuate arm) |
| 160 | distal end (of second arcuate arm) |
| 170 | handle |
| 180 | pressure or tension adjustment mechanism |
| 190 | first pressure member |
| 200 | second pressure member |
| 210 | first fingers for capturing pressure member |
| 220 | second fingers for capturing pressure member |
| 230 | expansion on first pressure member |
| 240 | expansion on second pressure member |

-continued

| Drawing Reference Numerals | |
|---|---|
| 250 | temple-engaging contoured portion (of first pressure member) |
| 260 | temple-engaging contoured portion (of second pressure member) |
| 270 | waist portion (of first pressure member) |
| 280 | waist portion (of second pressure member) |
| 290 | turnbuckle |
| 300 | first threaded screw |
| 310 | second threaded screw |
| 320 | pivot point |
| 330 | pivot point |
| 340 | planar tab (on first arcuate arm) |
| 350 | planar tab (on second arcuate arm) |
| 360 | chamber |
| 370 | batteries |
| 380 | vibrating motor |
| 390 | switch |

DETAILED DESCRIPTION OF THE INVENTION

Figure 2:
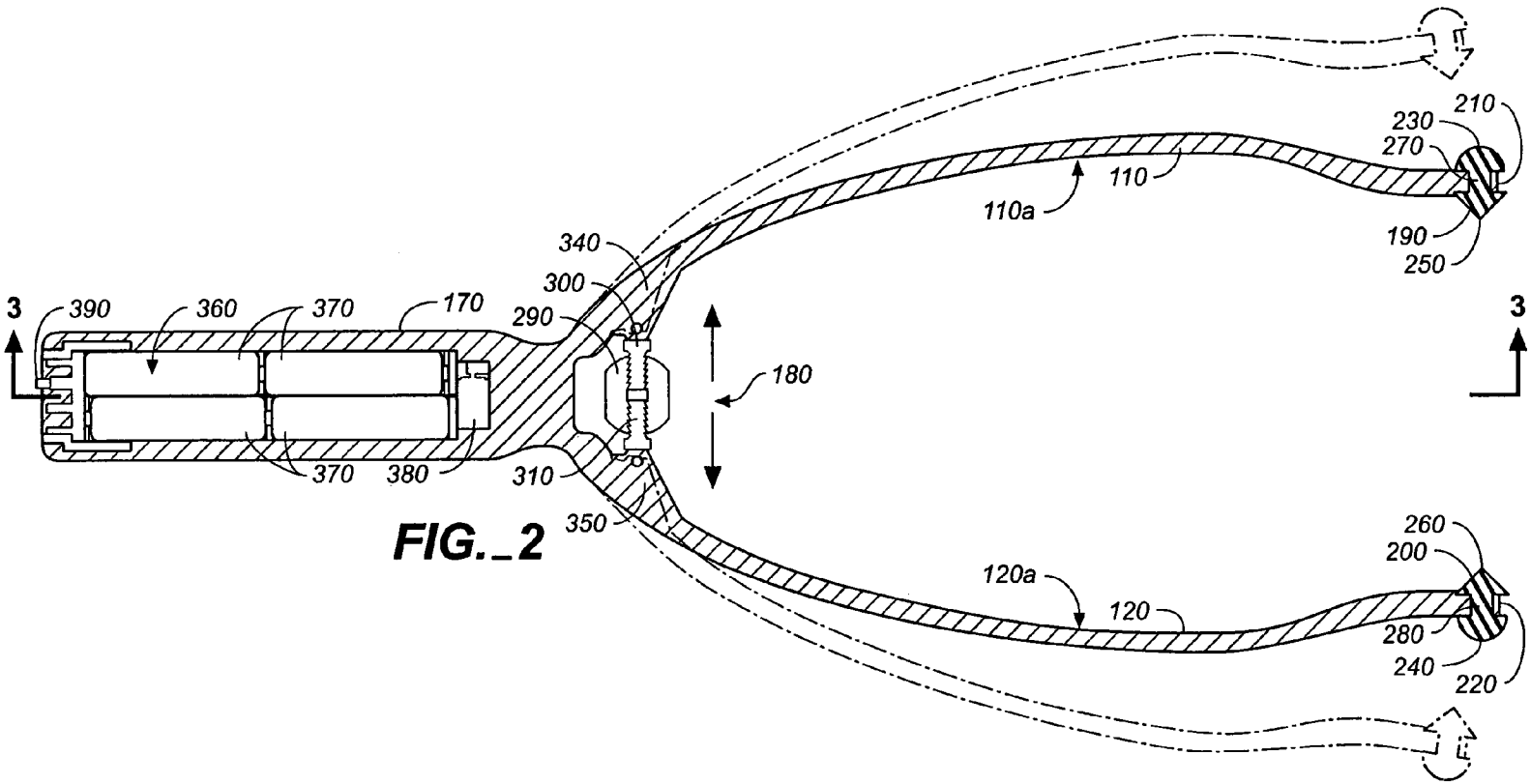
FIG. 2 is a cross-sectional top view of the inventive apparatus as taken along the section lines shown in FIG. 3.
Figure 3:
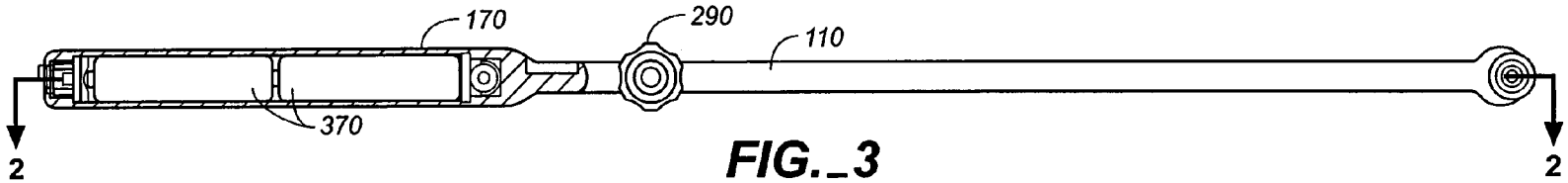
FIG. 3 is a cross-sectional side view in elevation of the apparatus of FIGS. 1 and 2, taken along the section lines shown in FIG. 2.

Referring to FIGS. 1 through 3, wherein like reference numerals refer to like components in the various views, there is illustrated therein a new and improved hand held temple massager, generally denominated 100 herein. These figures collectively illustrate a first preferred embodiment of the inventive apparatus, which in its most basic form comprises first and second flexible arcuate arms 110, 120, respectively, each having a proximal portion 130, 140, and a distal portion 150, 160. The proximal portions terminate in a connection to a handle 170, which is preferably integral with the proximal ends, such that the arms lie in substantially the same plane. A pressure or tension adjustment mechanism 180 is disposed between the first and second arcuate arms proximate the handle in the proximal portion of the arcuate arms.

The arcuate arms may be fabricated from a variety of suitable lightweight, moderately flexible materials, including, without limitation, carbon fiber, polypropylene, metal alloy, or even wood. When materials other than wood are selected, a single mold fabrication process may be employed to manufacture the inventive apparatus.

Each of the first and second arcuate arms includes means for capturing and retaining first and second pressure members, 190, 200, respectively, which are employed to apply pressure to the temple areas of a user during use. The retention means in each arm may comprise a simple through hole or, preferably, first and second C-shaped fingers 210, 220, respectively, into which a pressure member of suitably sized resilient material is squeezed. Each of the first and second pressure members includes an expansion 230, 240, a contoured temple-engaging portion (or tip), 250, 260, and a waist portion 270, 280, which is captured in the hole or fingers. As such, the pressure member can essentially be snapped into place. Furthermore, the contoured portion can be of various shapes and topographies so that the effect of applying pressure to the temple area when in use can be tailored to the preferences of the user. The configuration of the temple-engaging contoured portion can include a generally flat or planar surface or, by contrast, a sharply tipped configuration, the precise effect of which would be determined, in part, by the material from which the pressure member is fabricated. Such materials may include any of a number of expanded plastics or foamed plastic materials, such as polyvinyl chloride, polystyrene, polyurethane, polythene, and the like, or well-known elastomeric materials, including natural and synthetic rubbers. Intermediate conformations and surface textures on the temple-engaging portion are also possible, including, among others, nubs of various shapes or a plurality of points.

As noted, interposed between the arms proximate the handle is a tension adjustment mechanism 180 that provides the user with the ability to vary the amount of pressure exerted by the apparatus on the temple area during use. In a first preferred embodiment, the pressure adjustment mechanism may comprise a turnbuckle assembly comprising a turnbuckle 290 disposed between and threadably connected to first and second opposing threaded screws 300, 310, each pivotally connected to an arm at a pivot point 320, 330, preferably located on a built-up portion or planar tab 340, 350 on each arm. As shown in FIG. 2, turning the turnbuckle allows the user to selectively increase or decrease the distance between the arms to vary the tension applied to the temple area during use or simply to fit the device to a larger or smaller head.

As an alternative to a turnbuckle assembly, the tension adjustment mechanism may comprise one or more simple elastic or resilient bands disposed between two connection points, e.g., hooks, on the interior surface 110*a*, 120*a*, of each arm. Increased tension may be applied by installing either a larger and stronger band, or by installing additional bands.

The handle is preferably hollow and includes a chamber 360 for holding one or more portable power sources, i.e., batteries 370, in electrical contact with a vibrating motor 380 for providing vibration during use. The motor is activated by a switch 390, preferably located in the base of the handle.

From the foregoing disclosure it will be readily appreciated that the inventive apparatus provides a novel method of treating or preventing a tension headache. The method comprises the steps of: (a) providing a hand held self-massage apparatus as described above; (b) adjusting the pressure adjustment mechanism of the massage apparatus such that when the user places the arms around his or her head, the first and second pressure members exert pressure on the temple areas; (c) placing the massage apparatus such that the first and second pressure members are in contact with the temple areas; and (d) while holding the massage apparatus in a hand, massaging the temple areas by moving the handle of the massage apparatus. An additional step of utilizing the vibrating motor can be employed, as well, if desired by the user.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A hand held temple massager for simultaneously massaging both temples of a user, comprising:

a handle;

a first arm extending from said handle and having a distal portion and a proximal portion, said proximal portion connected to said handle;

a second arm spaced apart from said first arm and extending from said handle, said second arm having a distal portion and a proximal portion, each of said proximal portions having at least one connection point, and said proximal portion of said second arm is connected to said handle;

a first pressure member disposed in said distal portion of said first arm and having a temple-engaging portion for massaging one temple area of the user;

a second pressure member disposed in said distal portion of said second arm and having a temple-engaging portion for massaging the other temple area of the user such that said temple-engaging potion of said first pressure member and said temple-engaging portion of said second pressure member are spaced apart a distance substantially the same as that separating the temples on an average human head;

retention means disposed in said distal portions of said first and second arms for capturing and retaining said first and second pressure members;

a turnbuckle assembly disposed between, and connected to said connection points on said first and second arms for selectively increasing or decreasing the distance between said first and second arms, said turnbuckle assembly comprising first and second screws having opposing threads; connection means for pivotally connecting said first and second screws to said connection points on said proximal portion of said first and second arms, respectively; and a turnbuckle disposed between and threadably connected to said first and second screws;

a power source disposed in said handle; and a vibrating motor disposed in said handle and in electrical contact with said power source.

2. The apparatus of claim 1, wherein said first and second arms are flexible.

3. The apparatus of claim 1, wherein said first and second arms are fabricated from polymeric material.

4. The apparatus of claim 1, wherein said first and second arms are fabricated from material selected from the group consisting of carbon fiber, metal alloy, and wood.

5. The apparatus of claim 1, wherein said power source is one or more batteries.

6. The apparatus of claim 1, wherein said first and second pressure members are fabricated from material selected from the group consisting of natural rubber, synthetic rubber, and foamed plastic.

7. The apparatus of claim 1, wherein said first and second pressure members each have an expanded portion, and a waist portion, and wherein said retention means comprises fingers for clasping said waist portion of said pressure member.

8. The apparatus of claim 1, wherein said temple-engaging portion of said first and second pressure members has surface contours.

9. The apparatus of claim 1, wherein said temple-engaging portion is a tip.

* * * * *